US005558616A

United States Patent [19]

Barkus et al.

[11] Patent Number: 5,558,616

[45] Date of Patent: Sep. 24, 1996

[54] CENTRIFUGE ROTOR COVER HAVING CONTAINER SUPPORTS THEREON

[75] Inventors: David A. Barkus, Oakville; Daniel D. Hanle, Southbury, both of Conn.

[73] Assignee: E. I. Du Pont de Nemours and Company, Wilmington, Del.

[21] Appl. No.: 524,682

[22] Filed: Sep. 7, 1995

[51] Int. Cl.[6] ..... B04B 7/06; B04B 5/02

[52] U.S. Cl. ..... 494/12; 494/16

[58] Field of Search ..... 494/12, 16, 19, 494/20, 81, 85

[56] References Cited

U.S. PATENT DOCUMENTS

| | | | |
|---|---|---|---|
| 3,133,882 | 5/1964 | Mitchell et al. | 494/16 |
| 3,901,434 | 8/1975 | Wright | 494/16 |
| 3,998,383 | 12/1976 | Romanauskas et al. . | |
| 4,166,573 | 9/1979 | Webster . | |
| 4,202,487 | 5/1980 | Edwards . | |
| 4,304,356 | 12/1981 | Chulay et al. . | |
| 4,944,721 | 7/1990 | Carson | 494/16 |
| 5,354,254 | 10/1994 | Zabriskie et al. | 494/16 X |

FOREIGN PATENT DOCUMENTS

| | | | |
|---|---|---|---|
| 3805894 | 3/1989 | Germany | 494/16 |
| 9211092 | 7/1992 | WIPO | 494/16 |

*Primary Examiner*—Charles E. Cooley

[57] ABSTRACT

The cover for a fixed angle centrifuge rotor has an array of container support surfaces depending from the lower surface thereof. Each support surface is substantially cylindrical in configuration and has an axis associated therewith. Each container support surface is associated with a respective one of the cavities formed in the rotor body. In the most general case, when the rotor cover is attached to the rotor body, the axis of each container support surface lies in the same common radial plane as do the axis of the cavity with which the support surface is associated and the axis of rotation. In the common radial plane, the axis of a support surface is inclined at a predetermined angle with respect to the axis of rotation. The axis of the support may further be arranged to lie in parallel relationship to the axis of the cavity with which it is associated, or may define a predetermined angle with respect thereto.

5 Claims, 10 Drawing Sheets

CENTRIFUGE ROTOR COVER HAVING CONTAINER SUPPORTS THEREON

BACKGROUND OF THE INVENTION

1. Field of Invention

The present invention relates to a fixed angle centrifuge rotor having a cover with a support structure for supporting containers carried within the rotor.

2. Description of Prior Art

A centrifuge rotor may be classified on the basis of the angle defined between the rotor's vertically extending axis of rotation and the axis extending through each sample container-receiving cavity formed in the rotor body. A rotor in which the axis of the cavity lies at a predetermined acute angle (typically on the order of twenty degrees) relative to the rotor's vertical axis of rotation is termed a "fixed angle" rotor. U.S. Pat. No. 4,202,487 (Edwards) is believed a representative example of a fixed angle rotor. A rotor in which the axis of the cavity is parallel to the rotor's axis of rotation is known as a "vertical" rotor. U.S. Pat. No. 4,944,721 (Carson), assigned to the assignee of the present invention, discloses a vertical rotor.

When using either a fixed angle or a vertical rotor each of the sample containers must be individually capped or sealed to contain liquid during centrifugation. Moreover, each of the sealed or capped containers must be constrained within its respective cavity. In cases where the top of the container extends above the mouth of the cavity the performance of the rotor must be limited. Otherwise, the portion of the container above the cavity, which can not support its own mass under high centrifugal loads, may deform or fail.

Various container capping and constraining arrangements for containers have been proposed. In the vertical rotor case a threaded closure member is used to close the upper end of the container-receiving cavity. U.S. Pat. No. 4,166,573 (Webster) and U.S. Pat. No. 3,998,383 (Romanauskas), both assigned to the assignee of the present invention, disclose a form of cavity closure member. The above-referenced Carson patent discloses a cover for a vertical rotor having a container support structure for supporting the upper end of a container when the same extends above the mouth of the vertical cavity.

In a fixed angle environment U.S. Pat. No. 4,304,356 (Chulay et al.) discloses a cap that once inserted into the cavity "floats" on the tube disposed in the cavity. This type of arrangement requires the clinician to double the number of steps it takes to perform a centrifugation protocol, since in addition to inserting and removing the sample containers, the "caps" must be removed as well.

In view of the foregoing it is believed advantageous to provide a cover for a fixed angle centrifuge rotor that integrates a container support structure into the rotor cover.

SUMMARY OF THE INVENTION

The present invention is directed to a fixed angle centrifuge rotor. The rotor has a body with a plurality of cavities formed therein, with the axis of each cavity being inclined with respect to the axis of rotation. The axis of rotation and the axis of each cavity both lie in a predetermined respective common radial plane. The rotor includes a cover that has an array of container support surfaces depending from the lower surface thereof. Each container support surface is substantially cylindrical in configuration and has an axis of generation associated therewith. Each container support surface is associated with a respective one of the cavities.

In accordance with the present invention, in the most general case, when the rotor cover is attached to the rotor body, the axis of generation of each container support surface lies in the same common radial plane as do the axis of the cavity with which the support surface is associated and the axis of rotation. Moreover, in the most general case, for each common radial plane, the axis of a support surface is inclined at a predetermined angle with respect to the axis of rotation.

In addition to the foregoing relationship between the axis of the support surface and the axis of rotation, a predetermined relationship is defined between the axis of the support surface and the axis of the cavity with which the surface is associated. Thus, in one particular embodiment the inclination of the axis of a support surface is such that the axis of the support surface lies in parallel relationship to the axis of the cavity with which that support surface is associated. In a more particular instance, the axis of the container support surface is collinear with the axis of the cavity with which it is associated. In either of these dispositions, the support surface is particularly adapted to support the neck portion of a conventional bottle.

In another particular embodiment the inclination of the axis of a support surface is such that the axis of the support surface is itself inclined with respect to the axis of the cavity with which that support surface is associated. In this disposition the support surface is particularly adapted to support the neck portion of a canted neck bottle.

BRIEF DESCRIPTION OF THE DRAWINGS

The invention will be more fully understood from the following detailed description, taken in connection with the accompanying drawings, in which;

FIG. 1A is a side elevation view substantially entirely in section of the rotor in accordance with the present invention for use with a conventional straight-necked bottle, while

FIG. 2A is a plan view of the undersurface of the rotor cover of FIG. 1A showing an annular array of support surfaces disposed directly thereon, for use with a conventional straight-necked bottle, while

FIG. 3A is a plan view of the undersurface of the rotor cover of FIG. 1A showing an annular array of support surfaces disposed on a continuous annular support ring that is itself mounted to the cover, while

FIG. 4A is a plan view of the undersurface of the rotor cover of FIG. 1A showing an annular array of support surfaces disposed on respective segments of an interrupted annular support ring that are themselves mounted to the cover while

FIG. 7A is a plan view of the undersurface of the rotor cover of FIG. 6 showing an annular array of support surfaces disposed directly thereon, while

FIG. 8A is a plan view of the undersurface of the rotor cover of FIG. 6 showing an annular array of support surfaces disposed on a continuous annular support ring that is itself mounted to the cover while FIG. 9A is a plan view of the undersurface of the rotor cover of FIG. 6 showing an annular array of support surfaces disposed on respective segments of an interrupted annular support ring that are themselves mounted to the cover while

DETAILED DESCRIPTION OF THE INVENTION

Figure 1A:
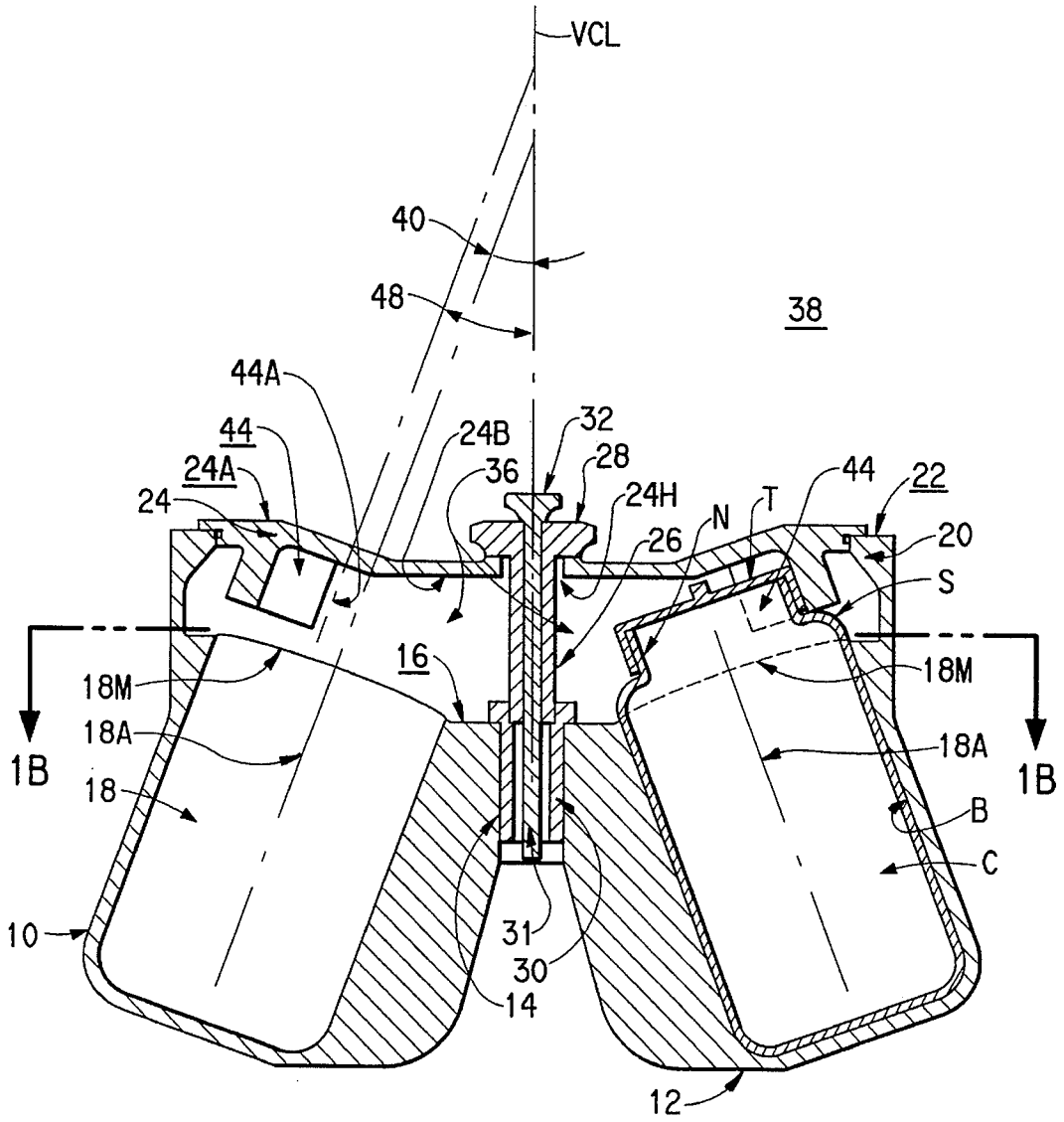

Throughout the following detailed description similar reference characters refer to similar elements in all Figures of the drawings.

FIG. 1A illustrates, in side sectional view, a fixed angle centrifuge rotor generally indicated by reference character 10 in accordance with a first embodiment of the present invention. The rotor 10 includes a body portion 12 that is typically integrally fabricated from a suitable material, such as aluminum, titanium or a composite. The body portion 12 has a threaded opening 14 arranged centrally and axially therein. The upper surface of the rotor body portion 12 defines a surface 16. A plurality of sample container receiving cavities 18 is arranged in an annular array in the body 12. An annular collar portion 20 is disposed about the periphery of the body portion 12 radially outward of the array of cavities 18. The collar portion 20 has an upper surface 22 thereon. The surface 22 is the uppermost surface on the rotor body 12.

The rotor 10 has a cover 24 that is disposed in an overlaying relationship with respect to the rotor body 12. The cover 24 has an upper surface 24A and a lower surface 24B and a central axial opening 24H that extends therethrough. The opening 24H receives the threaded shank 26 of a cover nut 28. The shank 26 threadedly engages the threaded potion of a drive adapter 30. The drive adapter 30 is itself received in the threaded central opening 14 of the rotor body 12. With the shank 26 secured to the drive adapter 30 the lower surface of the cover nut 28 engages against the upper surface 24A of the cover 24.

A threaded hold-down screw 31 having an enlarged knob 32 thereon extends through the cover nut 28. When installed in an instrument the hold-down screw 31 is received into a threaded portion of a mounting spindle (not shown) to secure the rotor 10 to the spindle. When so secured the peripheral portion of the undersurface 24B of the cover 24 abuts against the upper surface 22 of the collar 20. The undersurface 24B of the cover 24 and the upper surface 16 of the rotor cooperate to define an enclosed volume 36.

Figure 1B:
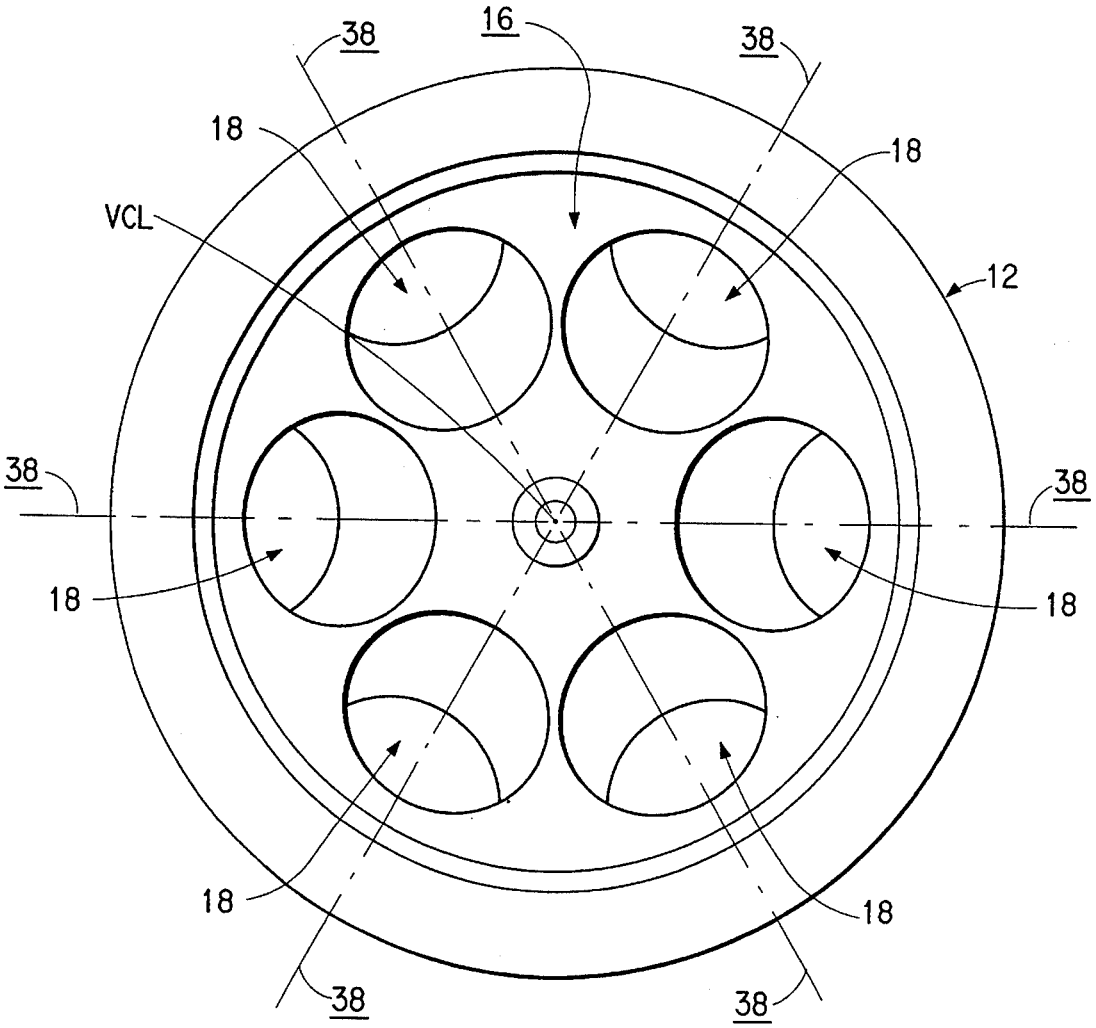
FIG. 1B is a plan view taken along view lines 1B—1B in FIG. 1A.

Each cavity 18 has an open mouth 18M and an axis 18A extending therethrough. As best seen in FIG. 1B the axis of rotation VCL and the axis 18A of each cavity 18 lie in a predetermined respective common radial plane 38 (e.g., the plane of FIG. 1A). As seen in FIG. 1B, the radial planes 38 emanate, in spoke-like fashion, from the axis of rotation VCL. As is best seen in FIG. 1A, in each of the radial planes 38 the axis 18A of each of the cavities 18 inclines at a predetermined angle 40 relative to the axis of rotation VCL. In a fixed angle rotor the angle of inclination 40 is in the range from twenty to forty degrees.

Each of the cavities 18 is sized to receive a sample container C therein. In FIGS. 1 through 5 the container C takes the form of a conventional straight neck bottle. The container C includes a main body portion B having a shoulder S that narrows into a neck N. The container C may either remain open or be suitably closed, as by a top, or cap, T. The uppermost portion (in the vicinity of the neck N and shoulder S) of the container C has a predetermined configuration associated therewith. This uppermost portion of the container C projects out of the mouth 18M of the cavity 18 in which it is received into the enclosed volume 36 disposed above the reference surface 16 and below the cover 24, as shown in FIG. 1A. To avoid the risk of rupture the projecting uppermost portion of the container C should be supported.

In accordance with the present invention the cover 24 of the rotor 10 includes a support structure for supporting the projecting uppermost portion of the container C. The support structure in accordance with the present invention comprises an array of support surfaces, each support surface being generally indicated by the reference character 44. Each container support surface 44 depends from the lower surface 24B of the cover 24 and extends into the enclosed volume 36. Each support surface 44 thus depends below the surface 22 on the collar 20. Each container support surface 44 is associated with a respective one of the cavities 18. The support surfaces 44 are each substantially cylindrical in configuration and each has an axis 44A associated therewith. The axis 44A may be viewed as the axis of generation of its associated support surface 44. By "axis of generation" is meant that axis about which a parallel line is rotated to generate the cylindrical surface 44.

In accordance with the present invention, in the most general case, when the rotor cover 24 is attached to the rotor body 12 the axis 44A of each container support surface 44 lies in the same common radial plane 38 as do the axis 18A of the cavity 18 with which the given support surface 44 is associated and the axis of rotation VCL. Moreover, in each common radial plane 38, the axis 44A of a support surface 44 is inclined at a predetermined angle 48 with respect to the axis of rotation VCL.

In addition to the foregoing relationship between the axis of the support surface and the axis of rotation, a predetermined relationship is defined between the axis 44A of the support surface 44 and the axis 18A of the cavity 18 with which the surface is associated. Thus, a first embodiment of the invention (shown in FIGS. 1A, 2A, 3A and 4A), when the cover 24 is secured to the rotor body 12 the axis 44A of the cylindrical support surface 44 is arranged to lie in the common radial plane containing the axis 18A of the cavity and the axis of rotation VCL in generally parallel relationship with respect to the axis 18A of the cavity 18 with which the surface 44 is associated.

Figure 2B:
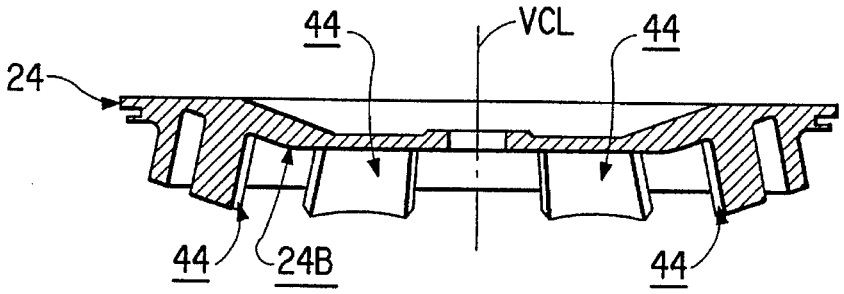
FIG. 2B is a sectional view taken along view lines 2B—2B of FIG. 2A.
Figure 2A:
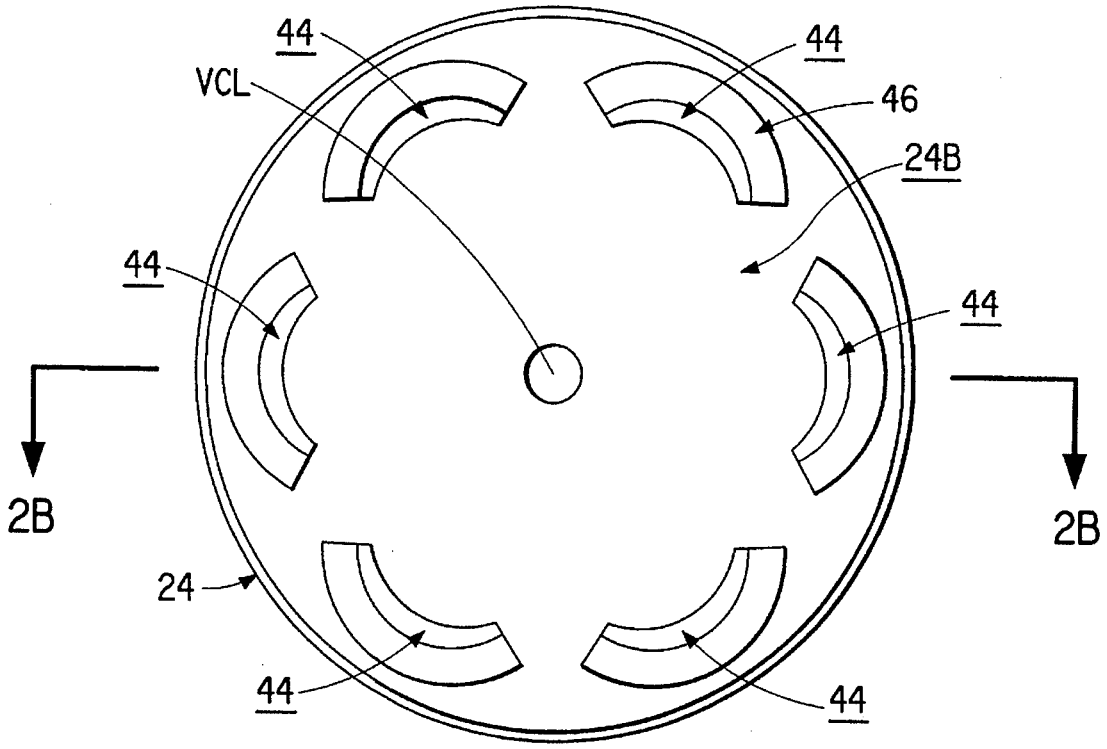

Structurally, the support surface 44 may be defined on the undersurface 24B of the cover 24 in any convenient manner. In FIG. 2A the surface 44 is formed on an abutment 46 that depends directly from the undersurface 24B of the cover 24. In this configuration the circumferential boundaries of the surface 44 are laterally coincident with the circumferential extent of the abutment 46 on which the surface 44 is disposed. In the arrangement shown in FIG. 3A a continuous annular ring 48 is disposed on the undersurface of the cover 24. Each of the surfaces 44 is formed in the ring 48 locally above the cavity 18 with which the given surface 44 is associated. As shown in FIG. 4A the ring 48 may be interrupted to form discontinuous ring segments 48S. Each surface 44 is localized in the circumferentially central region of each ring segment 48S.

Figure 3B:
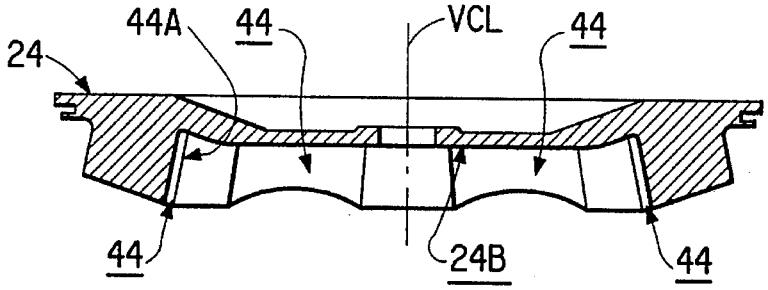
FIG. 3B is a sectional view taken along view lines 3B—3B of FIG. 3A.
Figure 3A:
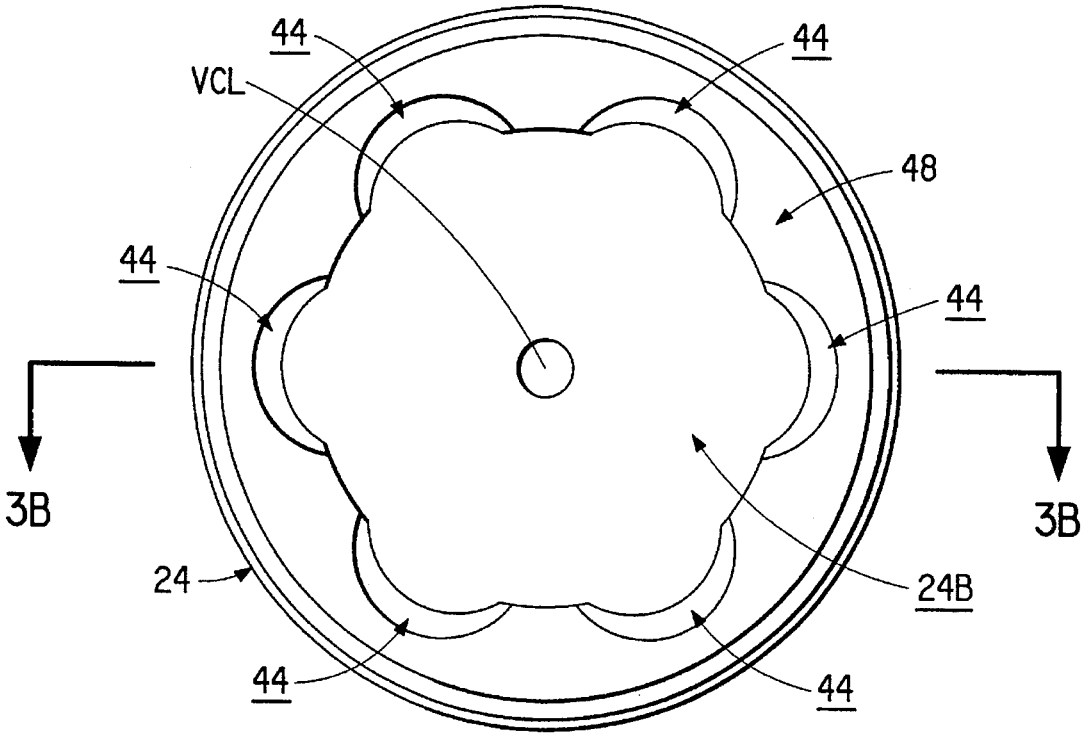
Figure 4B:
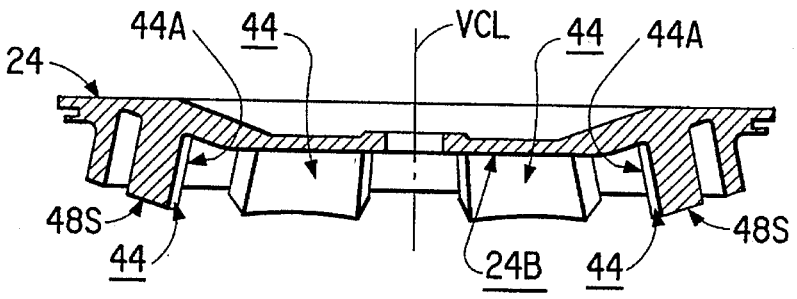
FIG. 4B is a sectional view taken along view lines 4B—4B of FIG. 4A.
Figure 4A:
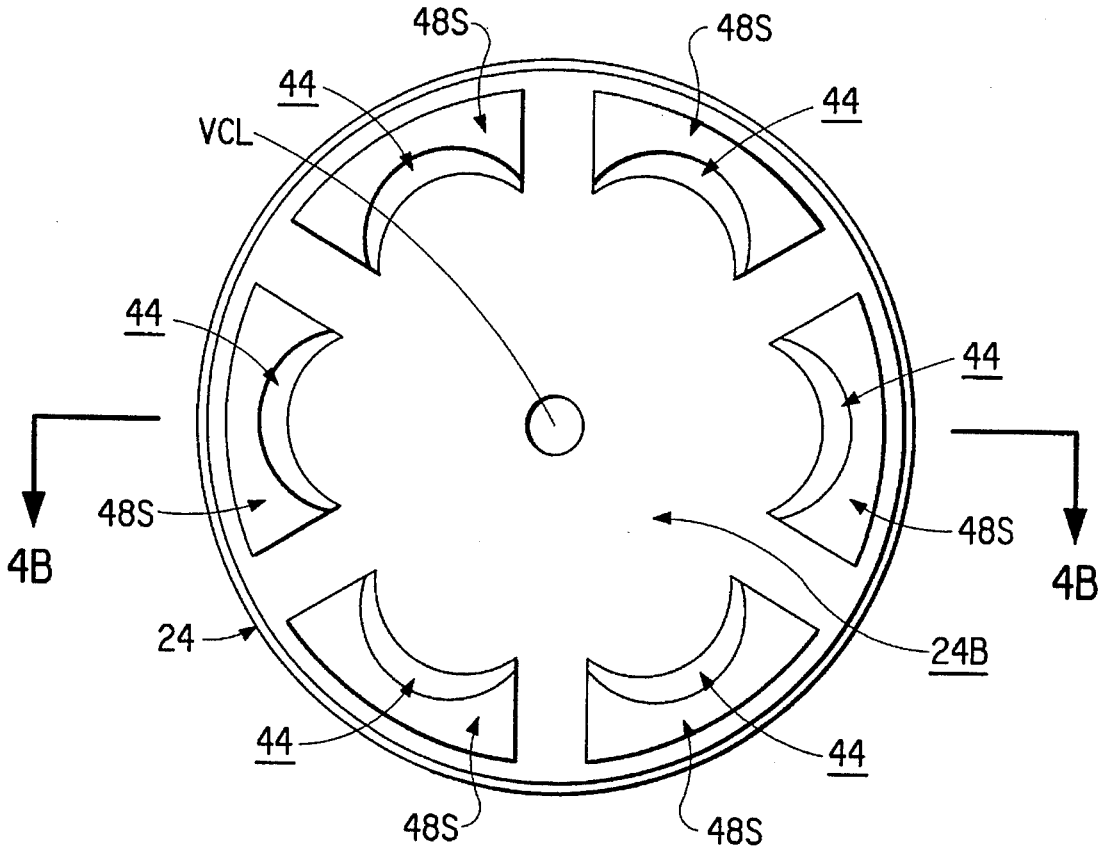

Whether formed in the manner shown in FIGS. 2A, 3A or 4A, positioning of the support surface 44 such that its axis 44A is parallel to the axis of the cavity 18A permits the surface 44 to abut against and support the top T closing the neck N of the container C. If left open, the surface 44 would abut and support directly against the neck N of the container C.

Figure 5:
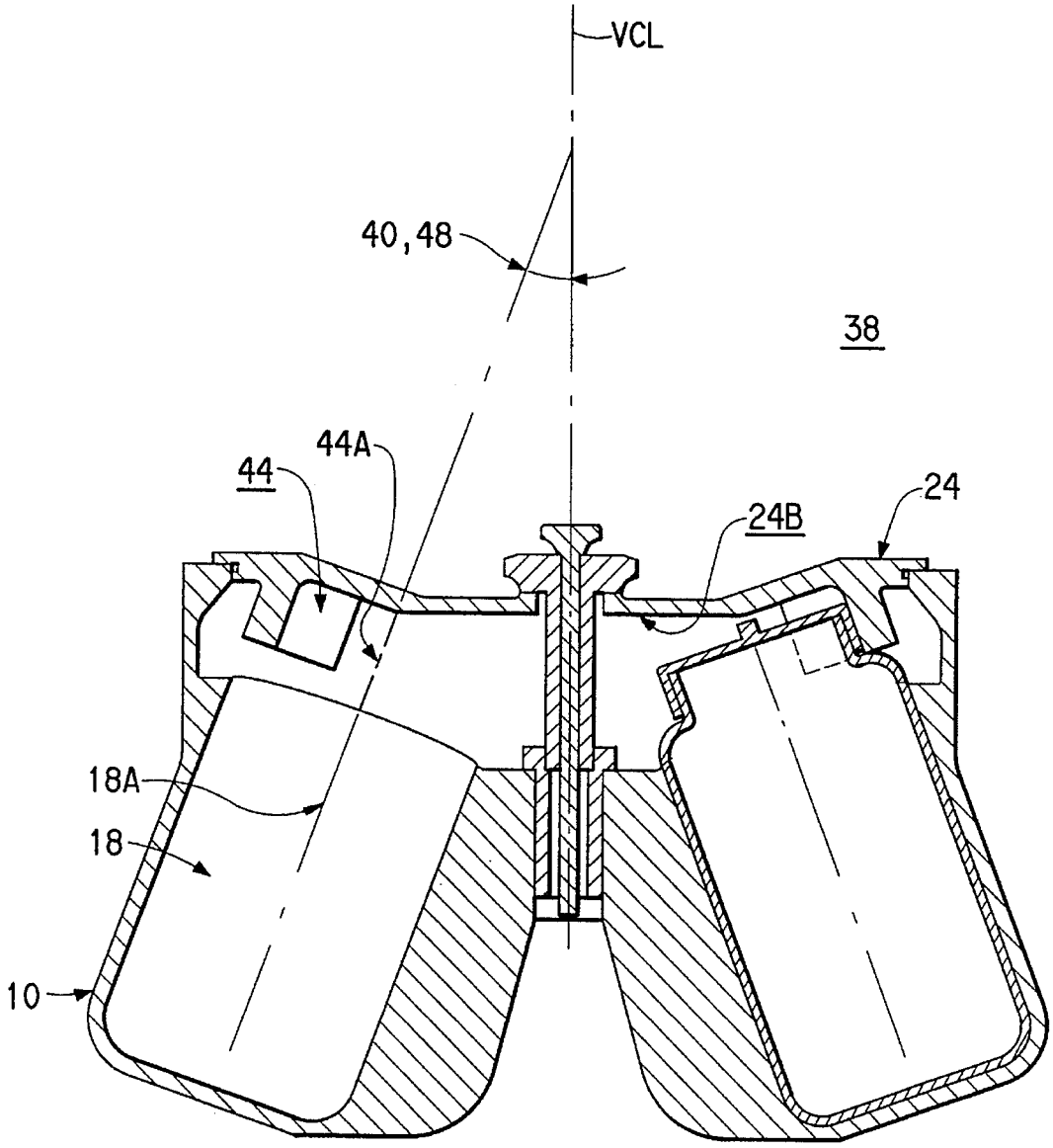
FIG. 5 is a side elevation view generally similar to FIG. 1A illustrating a modification of the cover shown therein.
Figure 6:
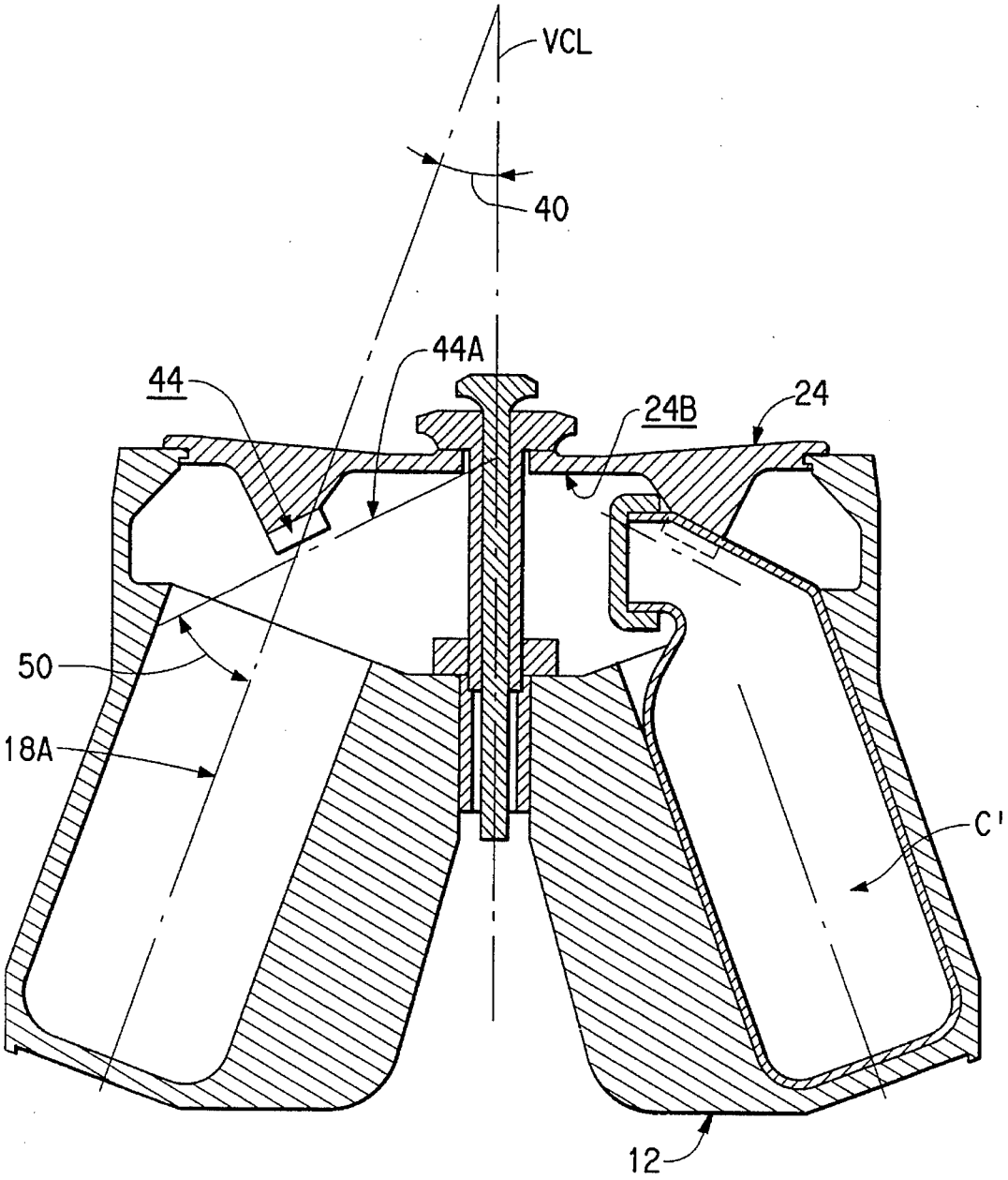
FIG. 6 is a side elevation view substantially entirely in section of the rotor in accordance with the present invention for use with a canted-neck type bottle.

A modification to the first embodiment of the invention is shown in FIG. 5. Whether formed in the manner shown in FIG. 2A, 3A or 4A, the surface 44 may be arranged such that its axis of generation 44A is collinear to the axis 18A of the cavity 18 with which it is associated. Such a modification would allow a closer match between the surface 44 and the neck of the container.

Figure 7B:
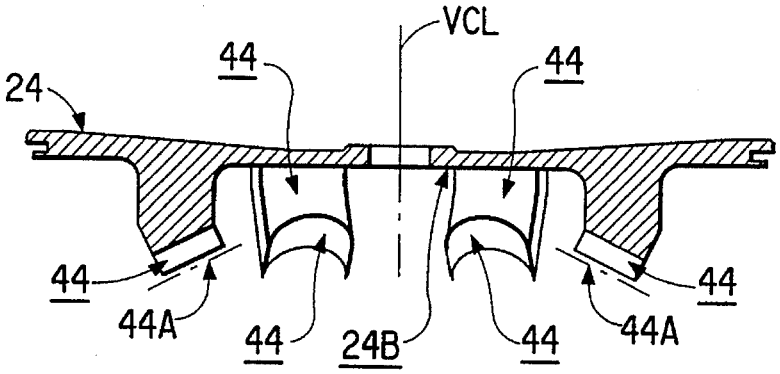
FIG. 7B is a sectional view taken along view lines 7B—7B of FIG. 7A.
Figure 7A:
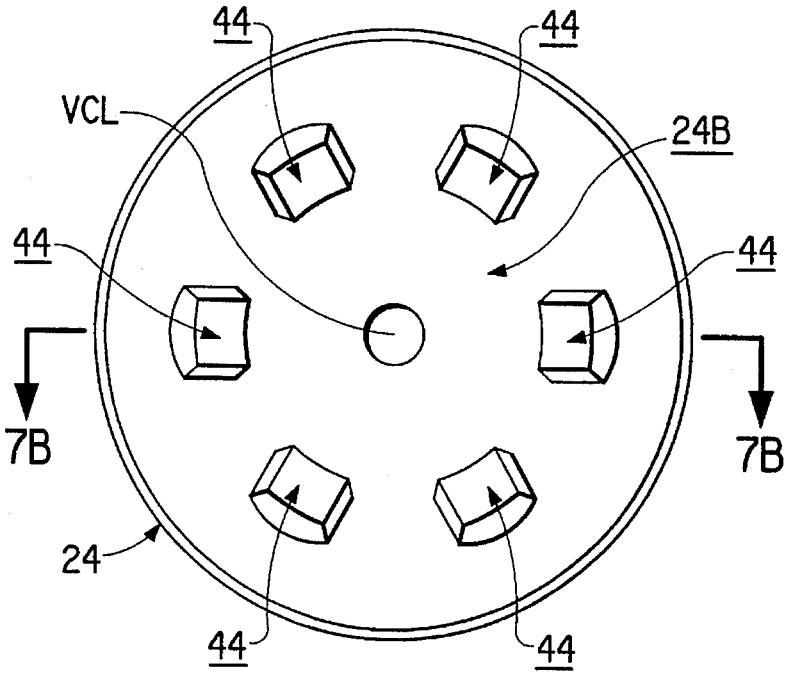
Figure 8B:
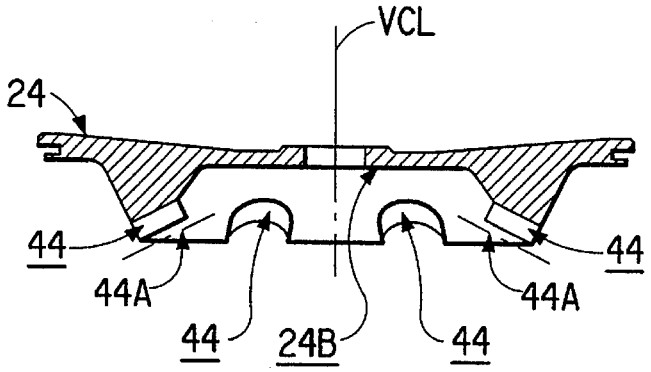
FIG. 8B is a sectional view taken along view lines 8B—8B of FIG. 8A.
Figure 8A:
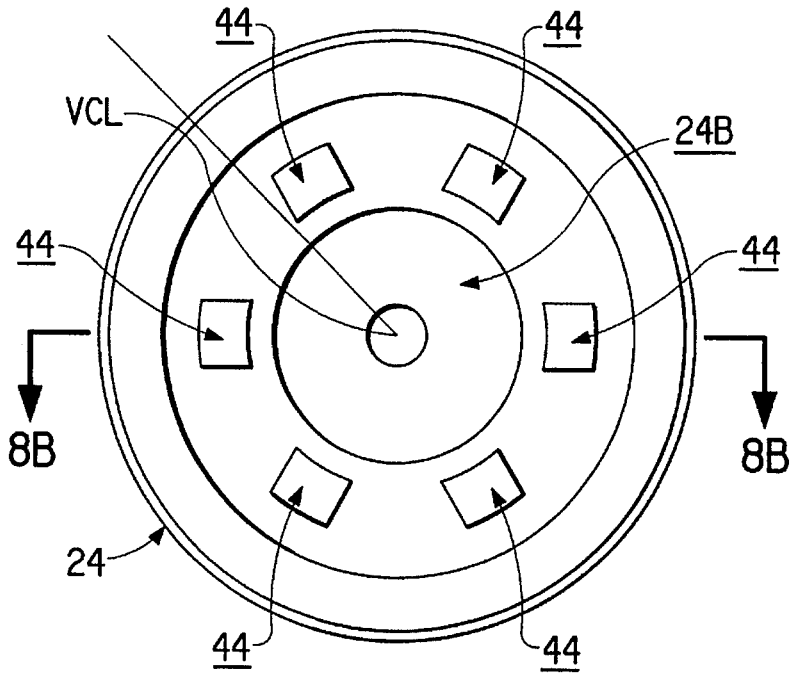
Figure 9B:
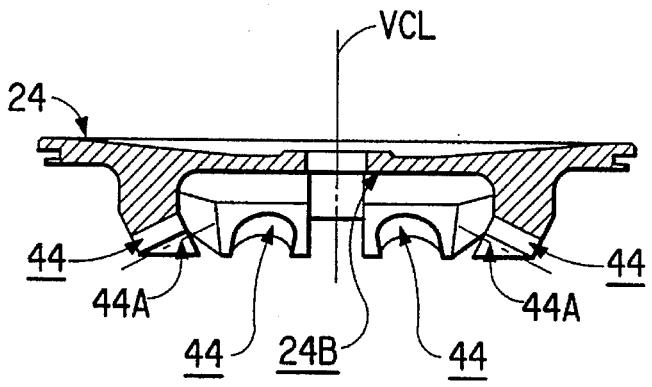
FIG. 9B is a sectional view taken along view lines 9B—9B of FIG. 9A.
Figure 9A:
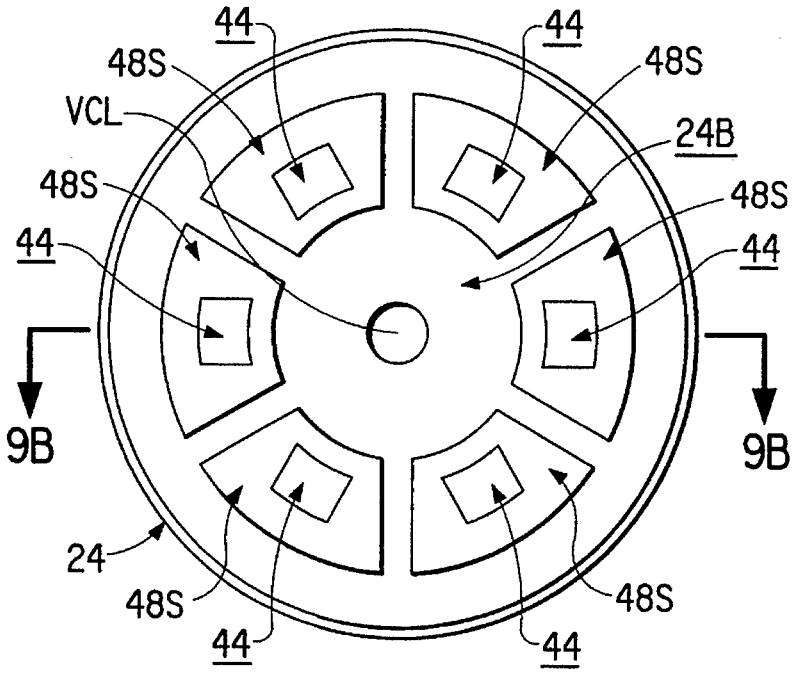

In some instances it is desirable to utilize a bottle such as that disclosed in published PCT application WO 92/11092. Such a bottle C' has a neck N that is itself inclined, or canted, with respect to the body thereof. The embodiment of the invention shown in FIGS. 7A, 8A or 9A is amenable for use with a canted neck bottle C'.

In accordance with this embodiment of the invention when the cover 24 is secured to the rotor body 12 the axis 44A of the cylindrical support surface 44 is arranged to lie in the common radial plane containing the axis 18A of the cavity and the axis of rotation VCL such that the axis 44A defines a predetermined angle 50 with respect to the axis 18A of the cavity 18 with which the surface 44 is associated. The angle 50 lies in the range from thirty-five to fifty-five degrees. As shown in FIGS. 7A, 8A and 9A, the surface 44 may be implemented using any of the alternatives as shown in connection with the embodiment of FIGS. 2A, 3A and 4A, respectively.

Those skilled in the art, having the benefit of the teachings of the present invention may effect numerous modifications thereto. It should be understood that such modifications are to be construed as lying within the contemplation of the present invention, as defined by the appended claims.

What is claimed is:

1. A centrifuge rotor rotatable about an axis of rotation, the rotor having a body with a plurality of cavities formed therein, each cavity having an axis, the axis of rotation and the axis of each cavity lying in a predetermined respective common radial plane, the axis of each cavity being inclined with respect to the axis of rotation, and a cover, the cover having an upper and a lower surface thereon, the cover having an array of container support surfaces depending from the lower surface thereof, each container support surface being associated with a respective one of the cavities, each container support surface being substantially cylindrical in configuration and having an axis, the axis of each container support surface being inclined at a predetermined angle with respect to the axis of rotation and with respect to the axis of the cavity with which it is associated, when the cover is attached to the body, the axis of each container support surface lies in the same common radial plane as the axis of the cavity with which it is associated and the axis of rotation.

2. The rotor of claim 1 wherein the body has an upper surface thereon, and wherein, when the cover is attached to the body, each container support surface lies below the upper surface of the rotor body.

3. The rotor of claim 2 wherein the cover has an annular ring depending from the lower surface thereof, and wherein each of the container support surfaces is formed on the ring.

4. The rotor of claim 3 wherein the annular ring is continuous.

5. The rotor of claim 3 wherein the annular ring is discontinuous.

* * * * *